US011004621B2

(12) United States Patent
Bobert

(10) Patent No.: US 11,004,621 B2
(45) Date of Patent: May 11, 2021

(54) RELAY

(71) Applicant: TDK Electronics AG, Munich (DE)

(72) Inventor: Peter Bobert, Falkensee (DE)

(73) Assignee: TDK ELECTRONICS AG, Munich (DE)

( * ) Notice: Subject to any disclaimer, the term of this patent is extended or adjusted under 35 U.S.C. 154(b) by 0 days.

(21) Appl. No.: 16/608,929

(22) PCT Filed: Apr. 23, 2018

(86) PCT No.: PCT/EP2018/060374
§ 371 (c)(1),
(2) Date: Oct. 28, 2019

(87) PCT Pub. No.: WO2018/197430
PCT Pub. Date: Nov. 1, 2018

(65) Prior Publication Data

US 2020/0251292 A1 Aug. 6, 2020

(30) Foreign Application Priority Data

Apr. 28, 2017 (DE) ..... 102017109210.2

(51) Int. Cl.
*H01H 1/50* (2006.01)
*H01H 1/20* (2006.01)
(Continued)

(52) U.S. Cl.
CPC ..... *H01H 1/504* (2013.01); *H01H 1/20* (2013.01); *H01H 50/18* (2013.01);
(Continued)

(58) Field of Classification Search
CPC ..... H01H 1/504; H01H 1/20; H01H 50/18; H01H 50/546; H01H 50/645; H05B 1/0213
(Continued)

(56) References Cited

U.S. PATENT DOCUMENTS 2,285,624 A 6/1942 Tanner
3,723,922 A * 3/1973 Loewen ..... H01H 33/666 335/68
(Continued)

FOREIGN PATENT DOCUMENTS

DE 1121690 B 1/1962
DE 4435795 A1 4/1996
(Continued)

*Primary Examiner* — Stephen S Sul
(74) *Attorney, Agent, or Firm* — Slater Matsil, LLP

(57) ABSTRACT

A relay is disclosed. In an embodiment a relay includes a first contact, a second contact, a movable element arrangeable in a closed position and in an open position; and at least one bimetallic strip, wherein the movable element electrically connects the first contact to the second contact in the closed position, wherein the first contact and the second contact are electrically isolated from each other when the movable element is arranged in the open position, and wherein the at least one bimetallic strip is configured to be deformed upon an increase in temperature such that it presses the movable element against the first and second contacts after deformation.

12 Claims, 2 Drawing Sheets

(51) Int. Cl.
*H01H 50/18* (2006.01)
*H01H 50/54* (2006.01)
*H01H 50/64* (2006.01)
*H05B 1/02* (2006.01)

(52) U.S. Cl.
CPC ..... *H01H 50/546* (2013.01); *H01H 50/645* (2013.01); *H05B 1/0213* (2013.01)

(58) Field of Classification Search
USPC ..... 337/333, 335, 342, 343, 344, 348
See application file for complete search history.

(56) References Cited

U.S. PATENT DOCUMENTS 3,991,391 A * 11/1976 Wafer ..... H01H 77/08 335/16
4,053,859 A * 10/1977 Hollweck ..... H01H 37/5409 337/91
4,124,833 A * 11/1978 Stoger ..... H01H 3/00 335/173
4,855,698 A * 8/1989 Cohen ..... H01H 89/08 335/14
4,931,757 A * 6/1990 Lemmer ..... H01H 89/06 335/131
4,975,665 A * 12/1990 Ohishi ..... H01H 89/08 335/14
5,638,038 A * 6/1997 Suzuki ..... H01H 9/542 335/35
5,973,585 A * 10/1999 Arnhold ..... H01H 71/40 335/145
6,064,289 A * 5/2000 Wieloch ..... H01H 50/20 335/10
6,310,528 B1 * 10/2001 Kuboyama ..... H01H 71/2409 335/132
9,601,296 B2 * 3/2017 Yang ..... H01H 71/16
2008/0073327 A1 * 3/2008 Annis ..... H01H 9/446 218/36
2014/0231235 A1 * 8/2014 Rosch ..... H01H 1/20 200/502
2016/0187943 A1 6/2016 Sun et al.
2017/0032916 A1 * 2/2017 Schaar ..... H01H 50/002
2017/0294281 A1 * 10/2017 Takeda ..... H01H 37/04

FOREIGN PATENT DOCUMENTS

DE 102007062357 A1 7/2009
JP S5246256 U 4/1977
WO 9611487 A1 4/1996
WO 2014101035 A1 7/2014

* cited by examiner

RELAY

This patent application is a national phase filing under section 371 of PCT/EP2018/060374, filed Apr. 23, 2018, which claims the priority of German patent application 102017109210.2, filed Apr. 28, 2017, each of which is incorporated herein by reference in its entirety.

TECHNICAL FIELD

The present invention is related a relay. A relay is an electromagnetically acting switch operated by electric current with at least two switch positions.

BACKGROUND

If the relay is in a closed switch position, an electrical circuit is closed between fixed contacts and a movable element and a current can flow. At the contact points between the fixed contacts and the movable element, the contact resistance is increased compared to the other conductors. Accordingly, high losses occur at the contact points and, as a result, heat loss and considerable heat can form. Particularly when using a relay in a closed housing or at high ambient temperatures, such heat loss can have a disturbing effect, as expensive cooling can become necessary under certain circumstances.

SUMMARY OF THE INVENTION

Embodiments provide an improved relay which, for example, can limit the generation of heat loss. In particular, the generation of heat loss should be avoided or at least reduced without the need for cooling.

In various embodiments a relay is proposed which has a first contact, a second contact and a movable element. The movable element can be in a closed position and in an open position. In the closed position, the movable element electrically connects the first contact with the second contact. The first contact and the second contact are electrically isolated from each other when the movable element is in the open position. The relay has at least one bimetallic strip which is configured so as to deform in the event of a temperature increase and arranged such that the bimetallic strip, after deformation, presses the movable element against the first and second contact. Here, the bimetallic strip can particularly preferably press the movable element against the first and second contact without deforming the movable element. In other words, only the bimetallic strip deforms, but not the movable element.

If the movable element is pressed against the first and second contact by the at least one bimetallic strip, the contact pressure between the movable element and the contacts can be increased. An increased contact pressure results in a reduction of the contact resistance between the contacts and the movable element. Accordingly, lower losses can occur if the movable element is pressed against the contacts by the at least one bimetallic strip. Lower losses can result in less heat being generated at the interfaces between the contacts and the movable element, thus avoiding excessive heating of the relay.

Otherwise, prolonged excessive heating could cause the surfaces of the contacts to burn off, damaging the relay and limiting the life of the relay. The use of the at least one bimetallic strip and the resulting increase in contact force can thus improve the lifetime of the relay.

A bimetallic strip can have two layers of different metals which are connected to each other in a material-locking or form-fitting manner. Bimetallic strips are configured so as to change their shape in the event of a temperature change. The change in shape is caused by different coefficients of thermal expansion of the metals used.

The bimetallic strip can have a resting state, which can also be described as a non-deformed state. The bimetallic strip can be in its resting state when the temperature of the bimetallic strip is below its activation temperature. The bimetallic strip can also have an active state, which can also be described as a deformed state. The bimetallic strip can be in the active state when the temperature of the bimetallic strip is above its activation temperature. In the active state, the bimetallic strip can be deformed due to the increase in temperature. The activation temperature can be higher than a normal room temperature of 21° C. The activation temperature of the bimetallic strip can be between 45° C. and 55° C., for example.

The at least one bimetallic strip is configured so as to deform after an increase in temperature. The deformation can occur if the temperature of the bimetallic strip exceeds the activation temperature mentioned above. The temperature increase can be caused by heat loss generated by a current flowing through the relay at the contact points of the movable element with the contacts.

The movable element can be movable relative to the contacts. The movable element can be a bridge. The movable element can be mechanically connected to an armature, which can be moved by a magnet.

The relay can comprise a magnet configured so as to move the movable element from the open position to the closed position when the magnet is switched on. The magnet can also be configured so as to move the movable element from the closed position to the open position when the magnet is switched off.

The magnet can be an electromagnet. The magnet can be a lifting magnet. When the magnet is switched on, it can exert a force on the movable element, which force moves the movable element to the closed position. The magnet can exert a force on an armature which is mechanically connected to the movable element, for example via a spring-loaded connection. If the magnet is switched off, the movable element can be moved from the closed position to the open position.

The magnet can be configured so as to hold the movable element in its closed position as long as the magnet is switched on. After a deformation of the at least one bimetallic strip as a result of the temperature increase, the bimetallic strip can exert an additional force on the movable element which also contributes to holding the movable element in the closed position and which ensures that the contact force with which the movable element is pressed against the contacts is increased.

A first end of the at least one bimetallic strip can be attached to the movable element. Accordingly, the bimetallic strip can exert a force directly on the movable element.

The movable element can have a top side facing the first and second contacts and a bottom side which is arranged opposite to the top side. On the top side a contact element can be arranged, which is configured so as to be electrically contacted directly with the first contact in the closed position of the movable element, wherein the first end of the at least one bimetallic strip is arranged on the bottom side of the movable element below the contact element. For example, a surface normal perpendicular to the top side and bottom side of the movable element can intersect both the contact element and the first contact. If the first end of the at least one bimetallic strip is arranged in the immediate vicinity of the contact element, the heat loss arising between the contact element and the first contact quickly reaches the at least one bimetallic strip and thus leads to an increase in the temperature of the at least one bimetallic strip. The closer the bimetallic strip is to the contact point of the first contact with the contact element, the more sensitive it can react to the resulting heat loss.

A second end of at least one bimetallic strip can be free-standing. Accordingly, the second end can be not firmly attached to another element. When the bimetallic strip is deformed, the position of the second end can change relative to the first end.

The relay can have a mechanical stop. The at least one bimetallic strip can be arranged in such a way that, when the movable element is arranged in the closed position and after the bimetallic strip has been deformed as a result of the temperature increase, the second end of the at least one bimetallic strip butts against the stop. In this case, a contact with the stop can mean that the bimetallic strip is trapped between the stop and the movable element. The bimetallic strip can exert a force on the movable element which increases the contact force between the movable element and the contacts.

The mechanical stop can be arranged on an armature connected to the movable element via a spring-loaded connection. The armature can be configured so as to be moved by the magnet. The armature and thus the mechanical stop can be moved along a greater distance than the movable element.

A contact force with which the movable element in the closed position is pressed against the first and second contacts can be determined by a spring constant of the spring-loaded connection when the movable element is in the closed position and the at least one bimetallic strip is not deformed as a result of an increase in temperature. The contact force can be determined by a contact pressure of the at least one bimetallic strip when the movable element is in the closed position and the at least one bimetallic strip is deformed as a result of an increase in temperature. The contact force, which is determined by the contact pressure of the at least one bimetallic strip, can be greater than the contact force, which is determined by the spring constant. Accordingly, a contact resistance between the contacts and the movable element can be reduced as a result of the higher contact force when the at least one bimetallic strip has deformed. Reduced contact resistance leads to lower losses and thus less heating due to heat loss.

The at least one bimetallic strip can be arranged to increase, after deformation, a contact force with which the movable element in the closed position is pressed against the first and second contact. Accordingly, after the bimetallic strip has been deformed, the contact force between the movable element and the contacts can be increased to reduce heat loss and prevent excessive heating of the relay.

The at least one bimetallic strip can comprise a layer comprising MnCu18Ni10 and a layer comprising FeNi36 or can or consist of these two layers. The layer containing MnCu18Ni10 can form an active component of the bimetallic strip.

The relay can have two bimetallic strips. A first bimetallic strip can be arranged in the immediate vicinity of the first contact and a second bimetallic strip can be arranged in the immediate vicinity of the second contact. All features disclosed in connection with the at least one bimetallic strip can also apply to both bimetallic strips. In a further alternative embodiment, the relay can have more than two bimetallic strips, each of which can be attached to the movable element.

BRIEF DESCRIPTION OF THE DRAWINGS

In the following, the present invention will be explained in more detail in conjunction with the figures.

DETAILED DESCRIPTION OF ILLUSTRATIVE EMBODIMENTS

Figure 1:
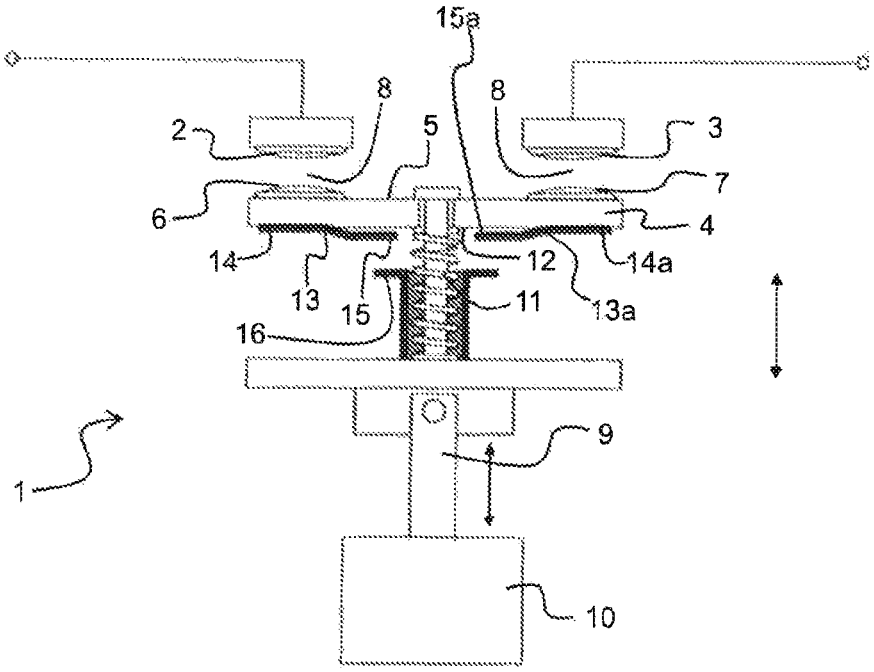
FIG. 1 shows a relay in an open position.

FIG. 1 shows a relay 1 in an open position. When the relay 1 is in its open position, no current can flow through the relay 1.

The relay 1 has a first contact 2 and a second contact 3. The relay 1 also has a movable element 4 which can be in an open position or in a closed position. FIG. 1 shows the movable element 4 in the open position. In the open position the movable element 4 does not electrically connect the first contact 2 with the second contact 3. In the open position of the relay 1 the movable element 4 is in its open position. In the closed position of the relay 1 the movable element 4 is in its closed position.

The movable element 4 has a top side 5 which faces the first contact 2 and the second contact 3. A first contact element 6 and a second contact element 7 are arranged on the top side 5 of the movable element 4. When the movable element 4 is in its open position, the first contact 2 and the first contact element 6 of the movable element 4 are separated by a gap 8. Furthermore, the second contact 3 and the second contact element 7 are also separated from each other by a gap 8. Accordingly, the first contact 2 and the second contact 3 are electrically isolated from each other.

The relay 1 also has an armature 9 and a magnet 10 configured so as to move armature 9. The magnet 10 is an electromagnet that can be switched on and off. The magnet 10 is a lifting magnet.

Figure 2:
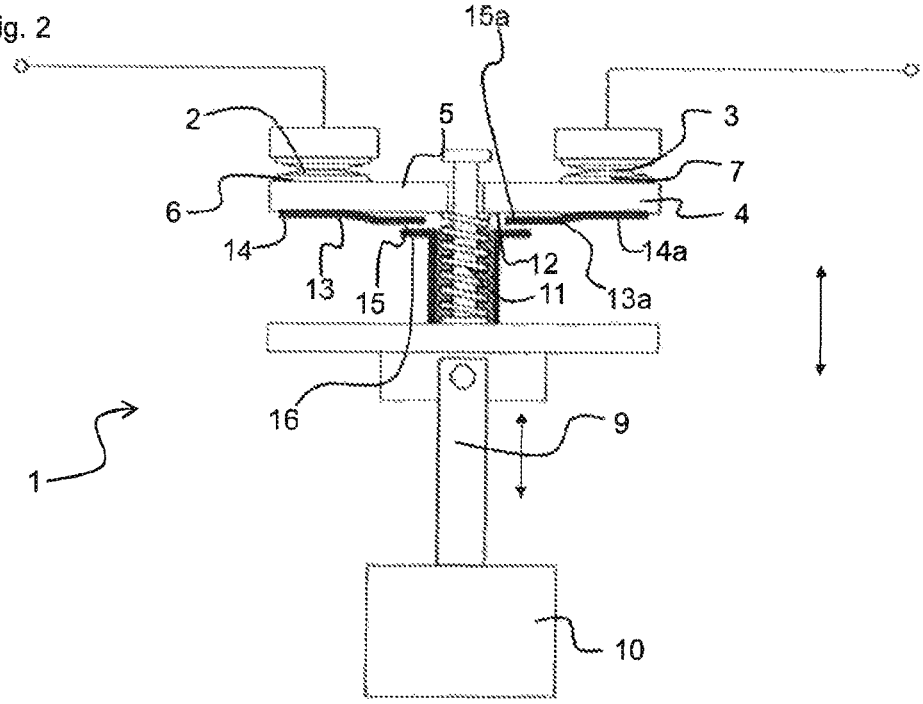
FIG. 2 shows the relay in a closed position, wherein the bimetallic strips are in a resting state.

The armature 9 can take a first position and a second position. FIG. 1 shows the armature 9 in its first position. If the armature 9 is in its first position, the relay 1 is in the open position. If the armature 9 is in the second position, as shown in FIG. 2, the relay 1 is in the closed position.

The armature 9 comprises a metallic material. When the magnet 10 is switched on, the field generated by the magnet 10 exerts a force on the armature 9, which moves the armature 9 from the first position shown in FIG. 1 to the second position shown in FIG. 2.

The armature 9 is mechanically connected to the movable element 4 via a spring-loaded connection 11, which has a mechanical spring. When the armature 9 is moved to its second position as a result of switching on the magnet 10, the movable element 4 also moves, compressing the spring-loaded connection 11 and thus absorbing a part of the movement of the armature 9, so that the movable element 4 moves along a smaller distance than the armature 9. When the magnet 10 is switched on, the armature 9 and the movable element 4 move in a direction towards the first and second contacts 2, 3.

Two bimetallic strips 13, 13*a* are arranged on a bottom side 12 of the movable element 4, the bottom side being arranged opposite to the top side 5. Each of the two bimetallic strips 13, 13*a* comprises a layer comprising a first material and a layer comprising a second material, the layers being bonded together. The first and second material differ in their coefficients of thermal expansion. For example, the first material can be MnCu18Mi10 and the second material FeNi36. When the bimetallic strips 13, 13*a* are exposed to a temperature change, they deform due to the different coefficients of thermal expansion of the two layers.

Each of the two bimetallic strips 13, 13*a* can be in a resting state and an active state. Due to a temperature change the bimetallic strips 13, 13*a* are transferred from their resting state into the active state. At a usual room temperature of 21° C., the bimetallic strips 13, 13*a* are in their respective resting state. If the temperature rises and exceeds an activation temperature, the bimetallic strips 13, 13*a* deform and thereby assume their active state. When the temperature decreases and falls below the activation temperature, the bimetallic strips 13, 13*a* return to their resting state. The active state of the bimetallic strips 13, 13*a* differs from the resting state in that the bimetallic strips 13, 13*a* are deformed. In particular, the expansion of the bimetallic strips 13, 13*a* in a direction perpendicular to the bottom side 12 of the movable element 4 is greater in the active state than in the resting state.

A first end 14, 14*a* of each of the two bimetallic strips 13, 13*a* is attached to the bottom side 12 of the movable element 4. The first end 14 of the first bimetallic strip 13 is fixed below the first contact element 6, which is arranged on the top side 5 of the movable element 4. The first end 14*a* of the second bimetallic strip 13*a* is arranged immediately below the second contact element 7. When the contact elements 6, 7 are heated accordingly, the resulting heat can also easily reach the bimetallic strips 13, 13*a* and heat the bimetallic strips 13, 13*a*.

A second end 15, 15*a* of the two bimetallic strips 13 is free-standing. Accordingly, the second end 15, 15*a* of the two bimetallic strips 13, 13*a* is not fixed and can move relative to the first end 14, 14*a*. In particular, the second end 15, 15*a* of the two bimetallic strips 13, 13*a* is not fixed to the movable element 4. Furthermore, the second end 15, 15*a* of the two bimetallic strips 13, 13*a* can be spaced from the movable element 4 as shown in FIG. 1 and can thus be further away than the first end 14, 14*a* from the movable element 4.

The relay 1 has a mechanical stop 16. The mechanical stop 16 is formed by a sleeve attached to the armature 9. In the open state of the relay 1, the second end 15, 15*a* of the two bimetallic strips 13, 13*a* is separated from the mechanical stop 16 by a gap.

FIG. 2 shows the relay 1 in its closed position, with the bimetallic strips 13, 13*a* each in their undeformed resting states. In the closed position of the relay 1 a current can flow through the relay 1. When the magnet 10 is switched on, it moves the armature 9 and thus the movable element 4 towards the contacts 2, 3. The movable element 4 is transferred to its closed position. In the closed position, the first and second contact 2, 3 are electrically connected to each other via the contact elements 6, 7 arranged on the movable element 4. Accordingly, a current can flow via relay 1. Immediately after closing the relay 1, it is not yet heated. Accordingly, the bimetallic strips 13, 13*a* do not undergo any deformation and initially remain in their resting state.

When the relay 1 is now closed and a current flows via the first contact 2 and the movable element 4 to the second contact 3, losses occur at the contact point between the first contact 2 and the first contact element 6 and between the second contact 3 and the second contact element 7, respectively, resulting from the limited contact force between the contacts 2, 3 and the contact elements 6, 7. Due to these losses heat is generated, which leads to a heating of the relay 1. In particular, the contacts 2, 3, the contact elements 6, 7 and their immediate surroundings are heated to high temperatures. Accordingly, the first ends 14, 14*a* of the bimetallic strips 13, 13*a* and thus the entire bimetallic strips 13, 13*a* are also heated.

The contact force between the movable element 4 and the contacts 2, 3 is essentially determined by the spring constant of the spring-loaded connection 11 when the movable element 4 is in its closed position and the bimetallic strips 13, 13*a*, as shown in FIG. 2, are in their respective resting states.

Figure 3:
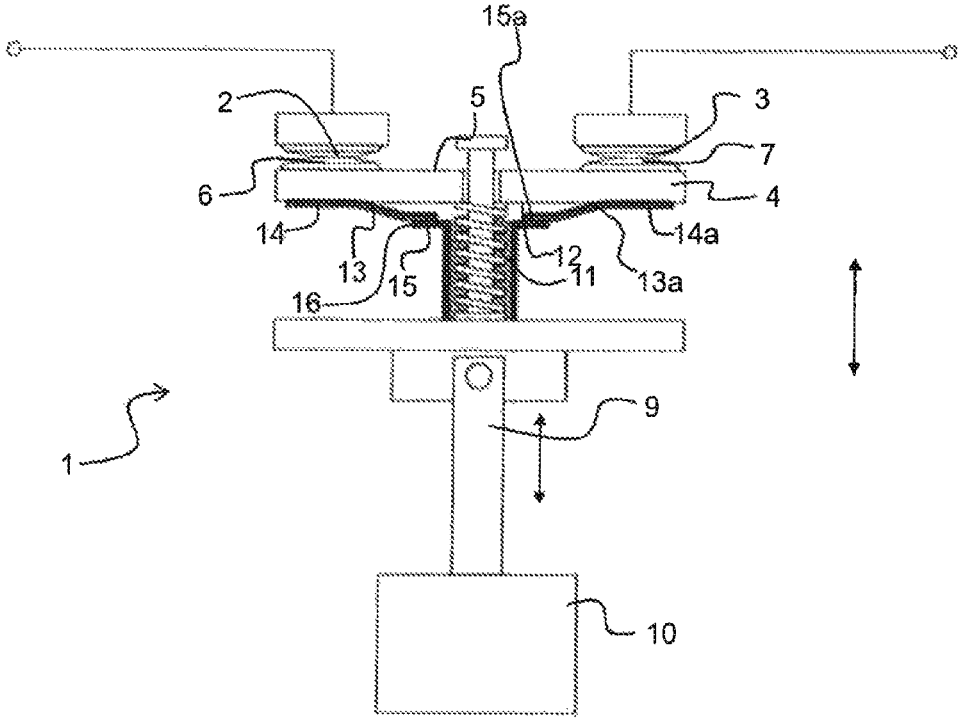
FIG. 3 shows the relay in its closed position with the bimetallic strips in an active state.

FIG. 3 shows the relay 1 in its closed state with the bimetallic strips 13, 13*a* deformed. When the bimetallic strips 13, 13*a* have been heated above the activation temperature, the bimetallic strips 13, 13*a* will be deformed. When the bimetallic strips 13, 13*a* are deformed, the second end 15, 15*a* of the respective bimetallic strip 13, 13*a* is moved away from the bottom side 12 of the movable element 4. The second end 15, 15*a* of the bimetallic strip 13, 13*a* strikes at the mechanical stop 16 of relay 1, which prevents further deformation of the bimetallic strip 13, 13*a*. This presses the bimetallic strip 13, 13*a* between the mechanical stop 16 and the movable element 4.

The bimetallic strips 13, 13*a* now exert a force on the movable element 4 which pushes the movable element 4 in the direction of the first and second contact 2, 3. This force exerted by bimetallic strips 13, 13*a* increases the contact force at contacts 2, 3. As shown in FIG. 3, the bimetallic strips 13, 13*a* press the movable element 4 against the first and second contact 2, 3 without deforming the movable element 4. Despite the deformation of the bimetallic strips 13, 13*a*, the movable element 4 is not deformed as shown.

Increasing the contact force provides a better connection between the contacts 2, 3 and the contact elements 6, 7 so that losses can be reduced. Accordingly, less heat is generated at the transitions between the first contact 2 to the first contact element 6 and between the second contact 3 to the second contact element 7. The bimetallic strips 13, 13*a* thus make it possible to increase the contact pressure between the movable element 4 and the contacts 2, 3 in the event of strong heating of the contacts 2, 3, thus reducing the losses at the transition points and thus limiting excessive heating.

If the relay 1 is now switched off by switching off the magnet 10, firstly the armature 9 is moved back to its open position. The movable element 4 is also moved to its open position. Now no current flows between the contacts 2, 3 and the movable element 4. Accordingly, no further heat due to losses is generated. Therefore the bimetallic strips 13, 13*a* cool down so that they are deformed back to their resting state after a short time. The configuration of the relay 1 shown in FIG. 1 is thus restored.

The invention claimed is:

1. A relay comprising:

a first contact;

a second contact;

a movable element arrangeable in a closed position and in an open position by an armature; and at least one bimetallic strip, wherein the movable element electrically connects the first contact to the second contact in the closed position, wherein the first contact and the second contact are electrically isolated from each other when the movable element is arranged in the open position, wherein the at least one bimetallic strip is configured to be deformed upon an increase in temperature such that it presses the movable element against the first and second contacts after deformation, and wherein the movable element is non-deformed by the bimetallic strip.

2. The relay according to claim 1, further comprising a magnet configured to move the movable element from the open position to the closed position when the magnet is switched on.

3. The relay according to claim 1, wherein a first end of the at least one bimetallic strip is fixed to the movable element.

4. The relay according to claim 3, wherein the movable element has a top side facing the first and second contacts and a bottom side arranged opposite to the top side, wherein, at the top side, a contact element is arranged, which is configured to be electrically contacted directly with the first contact in the closed position of the movable element, and wherein the first end of the at least one bimetallic strip is arranged at the bottom side of the movable element below the contact element.

5. The relay according to claim 1, wherein a second end of the at least one bimetallic strip is free-standing.

6. The relay according to claim 5, further comprising a mechanical stop, wherein the second end of the at least one bimetallic strip abuts the mechanical stop when the movable element is arranged in the closed position and after the at least one bimetallic strip has been deformed as a result of the increase in temperature.

7. The relay according to claim 6, wherein the mechanical stop is arranged at the armature connected to the movable element via a spring-loaded connection.

8. The relay according to claim 7, wherein a contact force with which the movable element is pressed against the first and second contacts in the closed position is determined by a spring constant of the spring-loaded connection when the movable element is in the closed position and the at least one bimetallic strip is not deformed due to the increase in temperature, and wherein the contact force is determined by a contact pressure of the at least one bimetallic strip when the movable element is in the closed position and the at least one bimetallic strip is deformed as a result of the increase in temperature.

9. The relay according to claim 1, wherein the at least one bimetallic strip is configured to increase a contact force with which the movable element is pressed against the first and second contacts after deformation in the closed position.

10. The relay according to claim 1, wherein the at least one bimetallic strip comprises a first layer comprising MnCu18Ni10 and a second layer comprising FeNi36.

11. The relay according to claim 1, wherein the relay comprises two bimetallic strips.

12. A relay comprising:

a first contact;

a second contact;

a movable element arrangeable in a closed position and in an open position;

at least one bimetallic strip, wherein a second end of the at least one bimetallic strip is free-standing; and a mechanical stop, wherein the second end of the at least one bimetallic strip abuts the mechanical stop when the movable element is arranged in the closed position and after the at least one bimetallic strip has been deformed as a result of a temperature increase, and wherein the mechanical stop is arranged at an armature connected to the movable element via a spring-loaded connection;

wherein the movable element electrically connects the first contact to the second contact in the closed position;

wherein the first contact and the second contact are electrically isolated from each other when the movable element is arranged in the open position; and wherein the at least one bimetallic strip is configured to be deformed upon the temperature increase such that it presses the movable element against the first and second contacts after deformation.

* * * * *